United States Patent [19]

Harris

[11] 4,109,472

[45] Aug. 29, 1978

[54] LONGWALL MINING APPARATUS

[75] Inventor: Robert Graham Harris, Longlevens, England

[73] Assignee: Dowty Mining Equipment Limited, Tewkesbury, United Kingdom

[21] Appl. No.: 761,539

[22] Filed: Jan. 21, 1977

[30] Foreign Application Priority Data

Jan. 24, 1976 [GB] United Kingdom ..... 2787/76

[51] Int. Cl.[2] ..... E21D 15/44

[52] U.S. Cl. ..... 61/45 D

[58] Field of Search ..... 61/45 D; 91/170 MP; 299/31-33

[56] References Cited

U.S. PATENT DOCUMENTS

| | | | |
|---|---|---|---|
| 3,216,201 | 11/1965 | Kibble et al. | 61/45 D |
| 3,246,576 | 4/1966 | Kibble et al. | 61/45 D X |
| 3,285,015 | 11/1966 | Carnegie et al. | 61/45 D |
| 3,434,389 | 3/1969 | Griseback | 61/45 D X |
| 3,889,475 | 6/1975 | Allen | 61/45 D |

FOREIGN PATENT DOCUMENTS

| | | | |
|---|---|---|---|
| 1,184,788 | 3/1970 | United Kingdom | 61/45 D |
| 1,202,358 | 8/1970 | United Kingdom | 61/45 D |

*Primary Examiner*—Dennis L. Taylor

*Attorney, Agent, or Firm*—Young & Thompson

[57] ABSTRACT

Mining apparatus for use on a mineral face comprising a plurality of roof supports arranged along the face, the roof supports being capable of undergoing advancing movements in sequence, and a manually operable control means on each of at least some of the supports, arranged such that actuation of the control means on one support will enable any other support within a predetermined range of supports adjacent said one support to undergo an advancing movement if the support preceding the said support in the sequence has unergone an advancing movement, the number of supports between any two successive supports which have a control means being less than the number in said predetermined range.

11 Claims, 8 Drawing Figures

LONGWALL MINING APPARATUS

Figure 1:
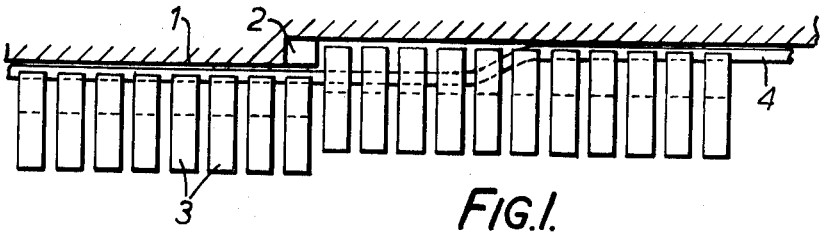

This relates to mining apparatus and more particularly it relates to mining apparatus of the longwall kind.

In this kind of apparatus coal or other mineral is excavated from a longwall surface and the roof is supported immediately adjacent the face by a plurality of roof supports arranged side-by-side along the face. The roof supports provide a working space along the face within which a coal cutting machine may operate to excavate coal or other mineral, any convenient means being provided for removing the excavated mineral. As the cutting machine advances along the face the roof supports are advanced towards the face, one at a time, behind the cutting machine to support the newly-presented roof. It is known to arrange roof supports operating on the Longwall system to be controlled in their advancing movement completely automatically from a remote control station, but due to variable conditions underground the automatic systems so far devised are not reliable and it is frequently necessary for miners to go along the line of supports to take corrective action. It has also been proposed for the line of roof supports to be advanced one at a time by miners who remain at the face during mining operations, but such systems require the miner to be close to any support which is being controlled. The present invention proposes a manually-controlled system for advancing roof supports in a longwall mining apparatus, which provides the miners with a substantial choice of position under the supports from which to control the roof support operations.

In accordance with the present invention a mining apparatus for use at a mineral face comprises a plurality of roof supports arraged along the face, the roof supports being capable of undergoing advancing movement in sequence and a manually operable control means on each of at least some of the supports arranged such that actuation of the control means on one support will enable any other support within a predetermined range of supports adjacent said one support to undergo an advancing movement if the support preceding the said support in the sequence has undergone an advancing movement, the number of supports between any two successive supports which have a control means being less than the number in said predetermined range.

Preferably each support has a manually operable control means.

By the term "advancing movement" is meant lowering of a support from engagement with a roof, advancing the support to another position closer to the mineral face and then re-setting the support against the roof.

The number of supports within the predetermined range of supports is greater than one and is preferably not more than 20.

An abutment such as a mineral conveyor may extend along the mineral face and at least some of the supports may include pushing means for urging the abutment towards the mineral face, after excavation of mineral therefrom. The manually operable control means on each support may be arranged such that actuation of the control means on one support will enable another support within the said predetermined range of supports adjacent said one support to effect a pushing operation on the abutment if the support including pushing means preceding said other support in the sequence has at least been caused to commence a pushing operation on the abutment.

Each support may include an advanceable roof supporting cantilever. The manually operable control means on each support may be arranged such that actuation of the control means on one support will enable the cantilever of any other support within the predetermined range to be extended if the cantilever of the support preceding said other support in the sequence has at least been caused to commence a cantilever extending movement.

The mining apparatus may include signalling means between the supports, whereby each support is enabled to undergo an advancing operation only when it receives two signals, referred to for convenience as a priming signal and an enabling signal. A priming signal is transmitted to a roof support when the preceding support in the sequence has undergone an advancing movement, and an enabling signal is transmitted to a roof support within the predetermined range when the operator actuates the manually operable control means on a support.

Where the supports are used in conjunction with a conveyor and a mineral cutting machine provided along the conveyor, the invention provides two alternative methods of operation, as follows.

The first, which may be called a closed system, is that in which the supports are close to the conveyor for the majority of the operation and are spaced substantially from the conveyor only immediately after passage of the cutting machine when the conveyor is pushed towards the new face. Supports operating on the closed system usually have extendible cantilever roof supports for extending to support the newly-presented roof immediately behind the cutting machine. The second may be called a spaced system in which the supports are spaced from the conveyor and each include a fixed forward roof extension extending over the conveyor, the supports being advanceable one at a time immediately after passage of the cutting machine so that the newly-exposed roof behind the cutting machine is supported. In this system the supports are thus close to the conveyor immediately behind the cutting machine. The various operational movements necessary for both the closed system and the open system may be controlled by the manually operable controlled means.

Figure 2:
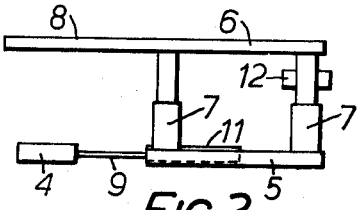
Figure 3:
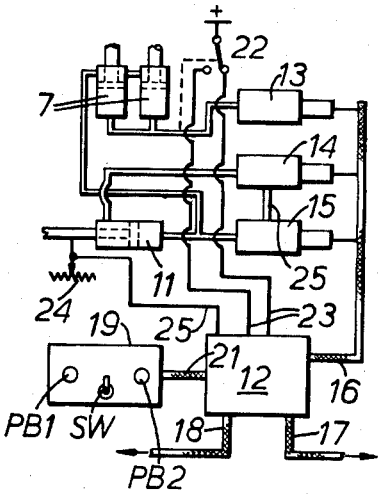
Figure 4:
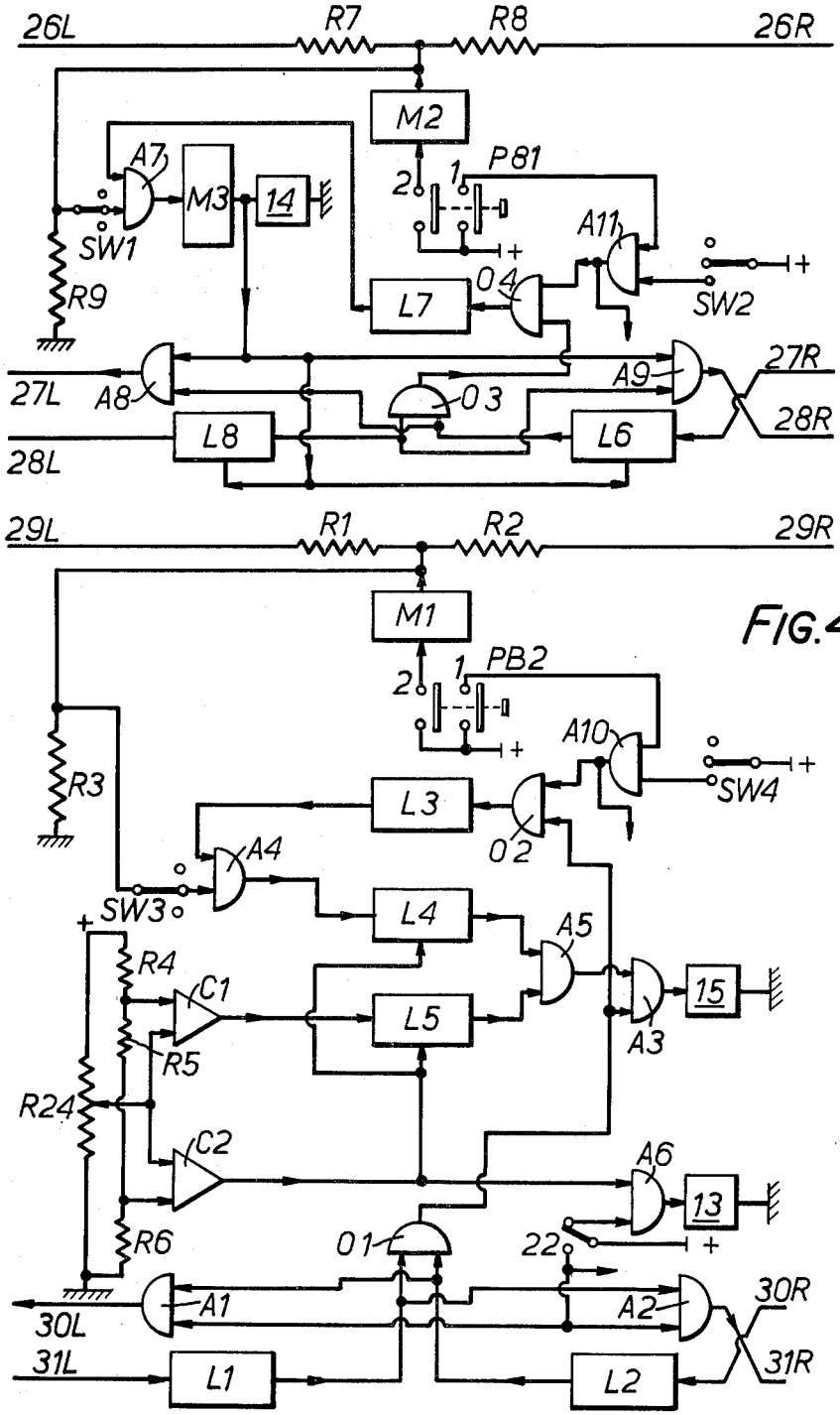

Two embodiments of the invention will now be described with reference to the accompanying drawings in which, FIG. 1 is a diagrammatic representation of a number of roof supports, conveyor and cutting machine operating on the spaced system, FIG. 2 is a diagrammatic side elevation of a roof support for use in FIG. 1, FIG. 3 is a hydraulic circuit diagram showing the arrangement of the various hydraulic rams in the support of FIG. 2, FIG. 4 is an electronic circuit diagram showing the logic arrangement in FIGS. 2 and 3, and, FIGS. 5, 6, 7 and 8 are drawings similar to FIGS. 1, 2, 3 and 4 respectively but for use on the closed system.

The logic circuits operate on the digital system and employ only two kinds of electrical signal for convenience referred to as a 0 and a 1. The electrical supply for operating the logic systems is a conventional intrinsically safe supply giving 12 volts. The positive side of this supply is indicated in its connection at various parts of the logic systems by the symbol +, the negative side of the safe supply being connected to ground. Parts of the logic system connected to the ground are indicated by the conventional ground symbol. Normally speaking a 1 signal is a voltage between 6 and 12 volts whilst a 0 signal is preferably of zero voltage but may extend up to 2 or 3 volts.

The logic systems include a number of conventional logic elements which are defined as follows.

1. AND gate. This device has two input connections indicated by inward arrows and one output indicated by an outward arrow. This and gate will deliver an output 1 signal only if it received an input 1 signal on each of its two inputs. If one or both inputs is or are 0 the cutput will be 0. Each and gate is identified by the reference letter A followed by an identifying number.

2. OR gate. This has two input connections indicated by inward arrows and one output connection indicated by an outward arrow. This device gives an output 1 signal only if one or both input signals is or are 1. Each Or gate is indicated by the letter 0 followed by an identifying number.

3. Latch. This device is also known as a flip-flop or a bi-stable. It has two input connections indicated by inward arrows and one output connection. A latch on receiving a short term 1 signal at one input will deliver a long term 1 signal at its output. On receiving a short term 1 signal at its other input the output will be changed to a long term 0 signal. Each latch is indicated by the letter L followed by an identifying number.

4. Mono-stable. This device has one input indicated by an inward arrow and an output indicated by an outward arrow. On receipt of a 1 signal at the input the output will deliver a 1 signal lasting for a predetermined time period after which the output signal will revert to 0 until such time as another 1 signal is received at the input. This device is indicated by the letter M, followed by an identifying number.

5. Comparator. This device has two input connections indicated by inward arrows and one output connection indicated by an outward arrow. The inputs to a comparator are normally variable voltages and the function of the comparator is to provide an output signal 1 when one input is higher than the other (usually a fixed level) and an output signal 0 when the input magnitudes are reversed. Each comparator will be indicated by the letter C followed by an identifying number.

Reference is now made to the first embodiment of the invention shown in FIGS. 1 to 4. In FIG. 1 the coal face is represented by reference numeral 1, a step in the coal face occurring at the position of the coal cutting machine 2. A plurality of roof supports 3 are located side-by-side along the coal face, each support being as shown in FIG. 2. A conveyor 4 of the well-known scraper chain type extends along the coal face in between the supports and the face. Each support as shown in FIG. 2 comprises a floor beam 5, a roof beam 6, and a plurality of hydraulic rams 7 positioned between the floor beam and the roof beam to support the roof beam in position. The roof beam is much longer than the floor beam and the forward end 8 of the roof beam projects forwardly beyond the floor beam 5. The conveyor 4 rests on the floor in front of the floor beams 5 and under the roof beam extensions 8. The conveyor 4 is connected to the floor beam by means of a relay bar 9, which connects to a double-acting advancing jack 11 mounted in the floor beam structure. The logic unit and manual control are indicated at 12, being mounted at the rear of each support. By reference to FIG. 1, each of the supports 3 illustrated is in plan view and shows the extent of the roof beam, a dotted line across each of these indicated supports indicating the forward extent of each floor beam 5. It will be appreciated that the majority of the supports are so arranged that the conveyor is spaced forwardly of the floor beam, in this position the advancing jack 11 being in its forwardly extended position. Thus the majority of the supports 3 are so arranged that their floor beams 5 are spaced from the conveyor 4.

The hydraulic circuit of a roof support is shown in FIG. 3. The roof support props, it will be seen, are double acting hydraulic jacks 7, connected in parallel with one another. For controlling the props 7 and the advancing jack 11, three electro-hydraulic valves, 13, 14 and 15, are provided. Valve 13 is the support setting valve and supplies liquid at pressure to the lower ends of the props 7 to hold the roof beam against the roof. The valve 14 is the push valve and supplies hydraulic liquid to the forward end of the advancing jack 11 in which the action of liquid at pressure is to pull the piston rod into the cylinder and thus to exert a forward push on the relay bar 9 to push the conveyor 4 forwardly. The valve 15 performs the lower advance function and for this purpose it is connected both to the upper ends of the cylinders of props 7 and to the rearward end of the advancing jack 11, so that liquid pressure supplied by valve 15 will simultaneously lower the roof beam from the roof and apply an advancing force on the floor beam of the support to advance the support forwardly. The conveyor forms the abutment on which the advancing jack operates in a sense to provide the advancing force, the conveyor normally being held in position by all other supports in the system. Here it should be explained that the arrangement of the advancing jack 11 is that the piston rod thereof is connected to the floor beam and the cylinder is connected to the relay bar 9. In this way hydraulic pressure supplied to the valve 14 to push the conveyor operates over the annular area of the piston providing a relatively small force, whilst the hydraulic force to advance the support is obtained by hydraulic pressure acting over the full area of the piston and providing a larger force.

The electrical supplies for the three valves, 13, 14 and 15, are derived from conductors leaving the logic unit 12. The multi-conductor cable 16 leaving the logic unit 12 carries connections to the three solenoids of valves 13, 14 and 15. Multi-conductor cables 17 and 18 also leave the logic unit 12 for connection respectively to the logic units of the adjacent right and left-hand supports. A switch unit 19 is connected by a multi-conductor cable 21 to the logic unit 12, the switch unit 19 forming the manually operable control means for the support. A pressure switch 22 is connected to respond to the hydraulic pressure in the lower ends of the prop 7 and conductors 23 carry pressure signals into the logic unit 12. A variable resistance 24 is located in the floor beam 5 to respond to the extension of the advancing ram 11, a voltage signal of such extension being carried by conductor 25 to the logic unit 12. The solenoid valve 14 is differently arranged from valves 13 and 15 in that on receiving a pulse of electricity it will open to permit hydraulic flow to the advancing cylinder in the conveyor pushing sense until the solenoid valve 15 is switched to supply hydraulic liquid to the advancing cylinder 11 in the advancing sense. To prevent valve 14 supplying pressure liquid when valve 15 is supplying pressure liquid an interconnecting pipe 25 carries pressure liquid from the valve 15 to valve 14 to operate in the sense to switch off hydraulic supply to the valve 14.

Reference is now made to FIG. 4 to show the logic circuit within the logic unit 12. The multi conductor cable 17 includes six conductors 26 to 31, each including the letter R to indicate that they are connected to the logic unit on the righthand side. Similarly the conductor 18 includes six conductors, 26 to 31, each including the reference letter L to indicate that they connect to the logic unit on the left. Thus for the logic unit 12 on the adjacent left-hand support its conductors 26R to 31R will effectively be connected to the conductors 26L to 31L in FIG. 4. Conductors 29 form the advance enable signal transmission means, conductors 30 and 31 form the advance prime signal transmission means, conductors 26 form the push enable signal transmission means and conductors 27 and 28 from the push prime signal transmission means.

Associated with the logic unit is the switch unit 19, the switches being shown in the logic circuit of FIG. 4. The switch unit includes two press buttons PB1 and PB2. Each of these press button switches includes two pairs of contacts indicated by numerals 1 and 2 which are connected together on operation of the press button. The switch unit 19 also includes a three position switch SW. The switch includes four banks of contacts indicated in FIG. 4 as SW1 to SW4. The switch SW has three positions, the central position being neutral, one extreme position being the self-prime position and the other extreme position being the lock out position. The switch is spring loaded so that it will not remain in the self-prime position but will return to neutral immediately it is released.

Description will now be given of the operations of a support intermediate to the two ends of the longwall. As the cutting machine progresses along the wall it cuts a web of coal from the face and as the cutting machine passes each support it is necessary for that support to advance itself towards the new face. For this purpose the miner controlling the operation locates himself under a support not too far away from the cutting machine, for example, within twenty supports of the machine. As he sees the cutting machine pass a support he will press his button PB2 to send an advance enable signal. Pressing button PB2 will supply a pulse from the logic supply into monostable M1, which will deliver an advance enable signal in the form of a short term 1 signal to the junction of two resistors R1 and R2. Resistor R1 connects to conductor 29L on the left and resistor R2 connects to conductor 29R on the right. The 1 signal will pass both to the left and to the right through conductors 29 and through resistors R1 and R2 in logic units both to the left and to the right. The preceding support will already have completed its advance to the new face and in so doing its pressure switch 22 will respond to the setting pressure in the prop 7 to deliver a 1 signal on the line 30L. On the support to be advanced this will be received on line 30R and will enter latch L2 causing it to deliver a 1 signal into or gate 01, which in turn will deliver a 1 signal to one input of and gate A3. This signal is the prime signal. When the miner presses button PB2 on a conveniently spaced support monostable M1 will deliver an enable signal in the form of a 1 signal to the junction of resistors R1 and R2 and this signal will proceed both to the left and to the right on lines 29. At the support to be advanced the enable signal will arrive at R3 and pass through switch contacts SW3 into and gate A4. The other input to and gate A4 comes from latch L3 which will be triggered to supply a 1 signal from or gate 02 which also receives at one input the priming signal from the outpput of or gate 01. Thus A4 provides a 1 signal at its output to trigger latch L4 and provides a long term 1 signal to one input of and gate A5. The other input to and gate A5 will arrive from latch L5 which, in turn, will depend on an input 1 signal from comparator C1. Comparator C1 will give the necessary signal provided that the advancing ram is fully retracted. When A3 receives its two input signals from A5 and 01 it will energise solenoid valve 15 to supply liquid at pressure to lower the props 7 and to the advancing jack to advance the support towards the face. As the support advances the voltage picked off at variable resistance R24 and fed into the logic unit will be fed to one input of each comparator C1 and C2. The other inputs to the comparators C1 and C2 are selected from fixed potentiometer voltages given by the series resistors R4, R5 and R6. As the advancing proceeds the output from C1 will change to 0 but this will not reset latch L5 and the advance will continue. At the full advance position the voltage picked off at R24 is arranged to generate a 1 signal which is fed both to the latches L4 and L5 and to and gate A6. The latches L4 and L5 will be reset so that and gate A5 gives out a 0 signal, which will then change A3 to give out a 0 signal and thus to de-energise solenoid valve 15. The output 1 signal from comparator C2, when fed to A6, will join with the second input to A6 from the pressure switch 22 in its low pressure position, thus generating a 1 signal from and gate A6 to energise solenoid valve 13 to supply liquid at pressure to the prop 7 and to set the support to the roof. When the support is set to the roof the pressure will rise and change switch 22 so that and gate A6 loses one input and switches off solenoid valve 13. The pressure switch 22 will then supply a 1 signal to the inputs of and gates A1 and A2. Latch L2 which is set by virtue of a prime signal coming from line 30R will supply a 1 signal to the other input of and gate A1 and thereby a prime signal will be transmitted to line 30L to reach the logic unit if the next adjacent support for advancing. Thus it will be seen that an advance prime signal from an advanced support will enter latch L2 through line 30R and when the support has gone through its advancing sequence on receipt of an enable signal from line 29R another advance prime signal will then be transmitted through line 30L to the next adjacent support to advance.

At a spacing of 3 or 4 supports behind the cutting machine 2 it becomes necessary to advance the conveyor onto the new face and, for this purpose, the miner in this remote position will press his switch PB1. At the remote support, operation of switch PB1 will act through its contact 2 to energise monostable M2 to cause it to supply a short term 1 signal, i.e. the push enable signal to the junction of resistors R7 and R8, this enable signal proceeding to the right and to the left through the lines 26L and 26R. At the support next to push the conveyor, a push prime signal is received through line 27R from the preceding support to energise latch L6 to deliver a 1 signal to one input of or gate 03, causing the latter to give out a 1 signal to one input of or gate 04. The resulting output from or gate 04 will energize latch L7 to give out a 1 signal to one input of and gate A7. When the enable signal is transmitted by the miner at the remote support the signal will arrive along line 26R and pass from the junction of R7 and R8 and switch SW1 to the other input of and gate A7 providing a 1 signal from A7 into monostable M3. The short term output will energise solenoid valve 14 for a short period, which will supply liquid at pressure to advancing jack 11 in the sense to push the conveyor. As previously mentioned, solenoid valve 14 is of a special construction which will continue to ensure application of liquid at pressure for pushing even though the output 1 signal from monostable M3 terminates. The 1 signal output from M3 is also fed to the inputs of two and gates A8 and A9 and to the re-set inputs of the latches L6 and L8. The re-set of latch L6 will change the output from L6 to a 0 signal and thus will cancel the effect of the prime signal transmitted on line 27R. Thus and gate A7 will now have 0 signals at its two inputs. Before the monostable M3 resets to a 0 signal its 1 signal output will have been fed to and gate A8 which, in conjunction with another 1 signal input from latch L6, will have transmitted a 1 signal as a prime signal onto line 27L leading to the next adjacent logic unit. Thus it will be seen that a support on receipt of a prime signal on line 27R will the of hydraulic pressure to the jack 11 in the conveyor pushing sense and immediately this is output a prime signal will pass out through line to next adjacent logic unit. Thus the advancing jacks of the supports which have prime and enable signals on lines 26R and 27R will continue to exert push on the conveyor to hold the conveyor against the face and this state will remain each until another advancing operation takes place at the support, in which case the energisation of solenoid valve 15 for lowering and advancing the support will cancel the setting of solenoid valve 14 to supply hydraulic pressure to advancing jack 11 for pushing the conveyor.

In order to initiate both the advancing sequence of a support or the pushing of the conveyor at the first support in a line, slightly different operation is necessary in order to provide the necessary prime signals, it being assumed that the logic units of all supports are identical. Assume that the first support on the right of the line supports is to be caused to undergo an advancing sequence. The miner will press button PB2 of the first support and simultaneously will operate switch SW into its self-primed position. The contacts 1 of button PB2 will then supply a 1 signal to the input of and gate A10 and the operation of the self-prime switch at contact SW4 will supply a second 1 signal to the second input of and gate A10. The output of and gate A10 in the form of a 1 signal will then operate through or gate 02 to set latch L3 to provide a 1 input to and gate A4, this input being the prime signal. The miner will then move to another support along the line of the supports and there press button PB2.

An enable signal will then be transmitted through lines 29L and 29R back to the first support logic unit to provide the second input and gate A4 to energise solenoid valve A15 and cause the lower and advance sequence as previously described. Here it will be appreciated that when the miner pressed button PB2 and operated the self-prime switch on the first support the operation of the prime switch at contacts SW3 will have prevented an enable signal passing directly from the output of M1 back to the second input of and gate A4.

In order to initiate pushing at the first support in the sequence the miner will go to the first support and press button PB1 which through contacts 1 will provide a 1 signal to one input of and gate A11. The miner also operates the self-prime switch which at SW2 will provide a second 1 signal input to and gate A11. The resulting 1 signal output will energise or gate 04 to provide a 1 signal input to Latch L7 which, in turn, provides a long term 1 signal to one input of and gate A7. Operation of the self-prime switch will, however, have acted at SW1 to disconnect the second input of and gate A7 so that the push will not start. The miner then moves to another support and presses button PB1 to provide an enable signal which will then be received through line 26L to provide the second input to and gate A7 which, as previously described, will energize solenoid valve 14 to cause conveyor pushing to start and to cause a prime signal to be transmitted through line 27L to the next adjacent logic unit.

In the transmission of an enable signal for conveyor push on line 26, or for support advance on line 29, it will be appreciated that the enable signal, in order to pass from the point at which the miner presses PB1 or PB2 to the support in which it has its operational effect, will pass through resistors either R7 or R8, or R1 or R2. At the support where the operation is to be initiated the enable signal must generate a sufficient voltage, either at resistor R3 or resistor R9 before the and gate A4 or A7 can be properly energised. This effect will mean that by suitable selection of resistors R1, R2, R3, R7 or R9 the number of supports over which an enable signal can be transmitted will be limited. Thus the combination of resistors R1, R2 and R3 on all supports forms the limiting means for the advance enable signal transmission means and the combination of resistors R7, R8 and R9 on all supports forms the limiting means for the push enable signal transmission means. In practice the arrangement is made that the number of supports is about 20, and this, in practice corresponds with the distance that a miner can expect to observe reliably what is taking place, bearing in mind that the only illumination which the miner will have is probably his helmet lamp. Nevertheless, since the miner can locate himself at a support up to 20 supports away from the position at which action is to take place, he will be comparatively safely away from any possible danger following either conveyor pushing or support advancing. It is also possible for the miner to place himself either upstream or downstream of the cutting machine, having regard to the direction of flow of ventilating air so that he does not need to inhale dust generated by operation of the cutting machine.

Figure 5:
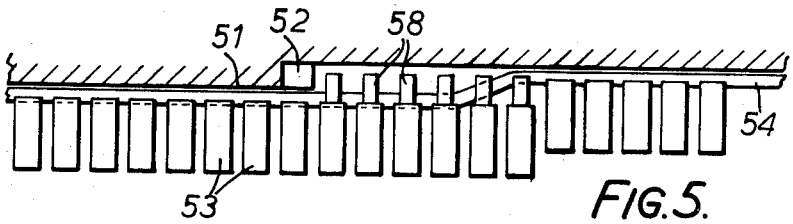
Figure 6:
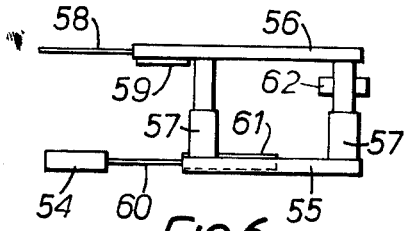

Reference is now made to the second embodiment of the invention illustrated in FIGS. 5 to 8 of the drawings. The illustrated system is the closed system in which the roof supports are normally drawn up closely to the conveyor. In FIG. 5 a cutting machine 52 is located for movement along a coal face 51, such cutting machine moving on the scraper chain conveyor 54 in the usual way. A series of supports 53 are located side-by-side along the face, each of the supports being as shown in FIG. 6. Each support comprises a floor beam 55, a roof beam 56 and a plurality of hydraulically extendible props 57 supporting the roof beam from the floor beam. The roof beam includes an extendible cantilever 58 extendible from its forward end under the action of a cantilever jack 59. The conveyor 54 is located in front of the floor beam 55 under the cantilever 58, the conveyor being connected to the floor beam through a relay bar 59 and an advancing jack 61. As shown in FIG. 6 the conveyor has been pushed to its fully forward extent by the relay bar and advancing jack. At the rear of the support a logic unit 62 is suitably mounted, together with a manual control in the form of a switch unit 63.

Under normal operational procedure of the system shown in FIG. 5, the cutting machine in travelling along the face will cut coal from the face and deposit such coal in a conveyor 54 for conveyance away from the face. As soon as the cutting machine passes a roof support the cantilever 58 thereof is caused to extend forwardly to support the newly exposed roof. At a few supports spacing behind the cutting machine the advancing jacks of the support are energised to cause the conveyor to be pushed over to the new face. Again, behind the conveyor position the supports themselves are caused one at a time to advance up the conveyor in its new position, the cantilever being simultaneously retracted with support advance. Thus it will be seen that the majority of the roof supports along the face are located closely to the conveyor and it is only at the position where the conveyor is pushed over to the new face that there is substantial spacing between a support and the conveyor.

Figure 7:
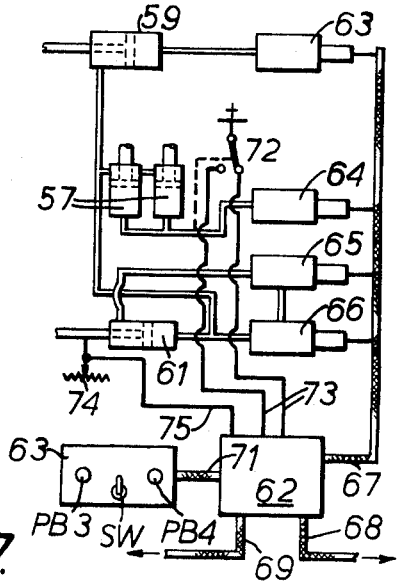

Referring now particularly to FIG. 7, the hydraulic circuit is shown associated with the support 53 of FIG. 6. The hydraulic circuit includes four solenoid operated valves 63, 64, 65 and 66. The valve 63, when energised, will supply pressure liquid to the cantilever jack 59 in the direction to extend the cantilever. The valve 64, when energised, supplies liquid to the hydraulic props 57 in a sense to cause them to extend and urge the roof beam into contact with the roof. The valve 65, when energised, supplies liquid to the advancing jack 61 to move it in the sense to push the conveyor forwardly. The valve 65 is of somewhat different construction to the other valves in that it needs only to receive a pulse of electricity in order to supply hydraulic liquid to jack 61 indefinitely. This hydraulic supply of liquid is terminated on receiving a hydraulic pulse from the valve 66. The solenoid valve 66 is connected jointly to the advancing jack, the props 57 and the cantilever jack, and when operative will supply liquid to these elements to cause the cantilever jack to withdraw the cantilever, to cause the props 57 to contract and to cause the advancing jack to advance the support forwardly. The logic unit 62 has four multi-conductor cables 67, 68, 69 and 74 extending therefrom. The cable 67 carries conductors to the four solenoid valve 63 to 66. The cable 68 extends to the logic unit of the adjacent support on the right-hand side. The cable 69 extends to the logic unit of the support on the left-hand side and the cable 71 extends to the switch unit 63, carried adjacent to the logic unit 62. A pressure switch 72 responds to the pressure within the props 57 and will switch onto one or the other of two contacts depending on whether the roof beam supporting pressure in props 57 is high or low. Two conductors 73 connect the switch 72 to logic unit 62. The piston rod of the advancing jack 61 co-operates with a variable resistance 74 whereby a position signal of the advancing jack 61 may be fed through conductor 75 into logic unit 62.

Figure 8:
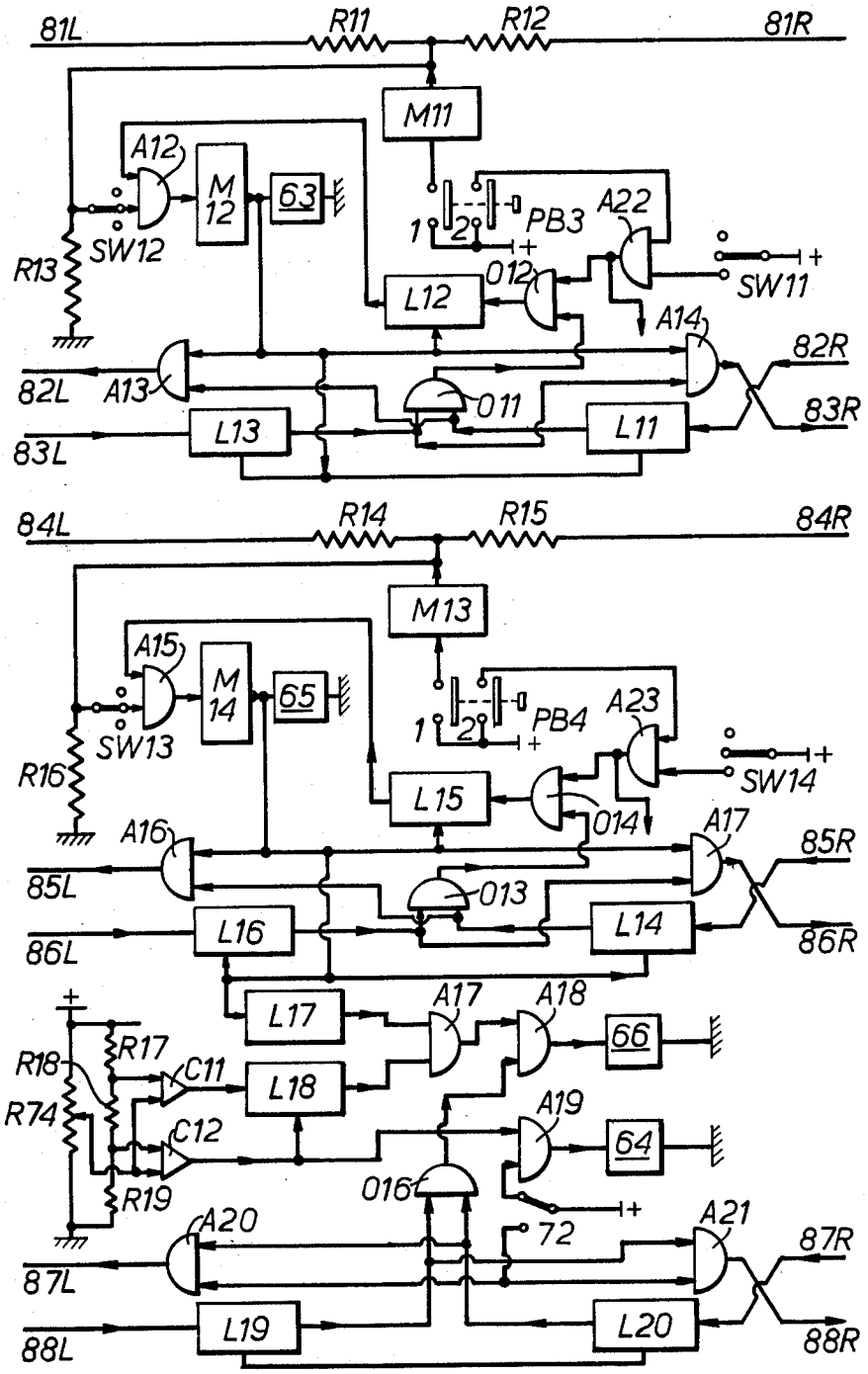

Reference is now made to FIG. 8, which shows the circuit diagram of the logic unit 62. The multi-conductor cable 68 comprises eight conductors 81 to 88, each of which is followed by the letter R to indicate that the conductors extends to the logic unit on the right. The multi-conductor cable 69 also includes eight conductors, 81 to 88, each followed by the letter L to indicate that the conductors connect to the logic unit to the left. Conductors 81 form the cantilever enable signal transmission means, conductors 82 and 83 form the cantilever prime signal transmission means, conductors 84 form jointly the push enable signal transmission means and the advance enable signal transmission means conductors 85 and 86 form the push prime signal transmission means and conductors 87 and 88 form the advance prime signal transmission means. The switch unit includes two press buttons indicated in FIG. 8 at PB3 and PB4. Each switch has two pairs of contacts 1 and 2, which are both closed simultaneously on depression of the push button. The switch unit also includes a three-position switch SW, having four banks of contacts SW11, SW12, SW13 and SW14. The central position of the switch is the neutral position, movement in one direction being to the prime position and movement in the other direction being to the lock-out position. The lock-out position and the neutral positions of the switch are stable but the switch is spring biased to move from the prime position to the neutral position. For each support the miner can initiate two operations; firstly that of cantilever advance by pressing button PB3 and secondly that of conveyor push and support lower advance and set, by pressing button PB4 the miner can press either of these buttons on any support within a predetermined range of the support being controlled. The final selection of the support to be controlled depends on the preceding support in the line of supports having completed, or at least initiated, an equivalent operation. For this purpose the logic system of each support is arranged to transmit a prime signal to the adjacent support on completion, or at least initiation, of its own movement. When the miner operates apress button he merely transmits an enable signal to a large number of supports in each direction within the predetermined range from the position where he presses his button.

Dealing firstly with the function of cantilever advance, assuming that the cutting machine is travelling from right to left, as shown in the drawing, a support on fully advancing its cantilever will despatch a cantilever prime signal on line 82L, which will arrive at the left-hand adjacent support on line 82R to the input of latch L11 to cause the latch to set. An output 1 signal from latch L11 is fed to the or gate 011 which will then deliver a 1 signal at its output to or gate 012. Or gate 012 will then deliver its output 1 signal to latch L12 to set this latch so that an output 1 signal is delivered to one input of and gate A12. Here the signal will stop until a cantilever enable 1 signal is received on line 81. The cantilever enable signal results from a miner at another support pressing button PB3. By pressing such button a miner makes a circuit from the logic supply through its contacts 1 to monostable M11, the cantilever enable signal passing to the junction of resistors R11 and R12 for connection to both lines 81L and 81R at the remote support. The signal passes along the lines 81 and at the particular support where the cantilever is to advance it will arrive at the junction of resistors R11 and 12 to be fed to resistor R13 and to the second input of and gate A12. Resistors R11, R12 and R13 form the cantilever enable signal limiting means which prevents the enable signal being effective beyond the predetermined number of supports from the miner's position. At this point and gate A12 will deliver an output 1 signal into monostable M12 which will then deliver an output 1 signal to the solenoid of solenoid valve 63, causing the latter to supply hydraulic liquid for a short time period to the jack 59 to advance the cantilever. The time period of the output given by monostable M12 is sufficient for full advance of the cantilever. The output from monostable M12 is also fed to the inputs of and gates A13 and A14, to the resetting input of latch L12 and to the resetting inputs of latches L11 and L13. Latches L11 and L12 are thus reset and the output signal of and gate A12 becomes a 0. At the instant when M12 delivers its output 1 signal and gate A13 will be receiving a 1 signal from latch L11 and will thus transmit a momentary 1 signal to the left on line 82L which forms a prime signal to be received by latch L11 on the adjacent left-hand logic circuit. Immediately latch L11 resets one input to and gate A13 becomes a 0 and the output signal on line 82L becomes a 0. In this way the cantilever is fully advanced and the prime signal is given to the adjacent left-hand support.

At some five or six supports behind the cutting machine it becomes necessary to push over the conveyor and to advance the support to a new position. For this to happen the logic unit requires to receive a push prime signal and a support advance prime signal on line 87R from the right-hand logic unit and also one enable signal on line 84. The prime signal received on line 85R is a signal given out on initiation of conveyor push on the right-hand support and the prime signal received on line 87R is a signal of completion of the lower advance set sequence of the right-hand support. Dealing initially with conveyor push the receipt of the prime signal on line 85R will set latch L14 to give a 1 signal to one input of or gate 013. The output 1 signal from gate 013 enters or gate 014 to give a 1 signal to the input of latch L15 which, in turn, gives a 1 signal to one input of and gate A15. At this stage the signal will remain until an enable signal is receiver on the line 84 from another support where the miner has positioned himself. At this other support the miner will press his button PB4 which will make a circuit from the logic supply to contacts on to monostable M13 so that a short term 1 signal is delivered to the junction of resistors R14 and R15. This enable signal will travel along the line 84 and at the support which is to undergo the conveyor push and support lower advance set sequence, it will arrive at the second input of and gate A15 to give a 1 signal into monostable M14. Resistors R14, R15 and R16 form a limiting means for thee transmission of the support advance and conveyor push enable signals generated when the miner presses button PB4 and will ensure that the signal is not effective beyond the predetermined number of supports from the miners's position. The short term output 1 signal from monostable M14 is fed to solenoid valve 65 which will then deliver an output to advancing jack 61 in the sense to push the conveyor. The short term output 1 signal from monostable M14 is also fed to the reset inputs of latches L14, L15 and L16 and to the input of and gates A16 and A17. At the and gate A16 there will momentarily be two 1 signals at its two inputs before latch 14 is reset and thus a 1 signal will be sent out on line 85L to be received by latch L14 in the adjacent logic circuit. This signal is the prime signal following initiation of conveyor push.

A short term 1 signal from monostable M14 is also fed to the set input of latch L17 altering it to give a 1 output signal to one input of and gate A17. Comparator 11 receives two input signals, one from the moving contact on resistor R74 and the other from a fixed voltage signal picked off from the junction of resistors R17 and R18 within the chain comprising series connected resistors R17, R18 and R19 connected across the logic supply. At the full extension of the advancing jack in pushing the conveyor to the new face, comparator C11 will receive two inputs with the difference in the right sense so that the output of C11 is a 1 signal fed to the input of latch L18. The output 1 signal from latch L18 forms a second input to and gate A17, which then gives an output 1 signal to once input of and gate A18. Here the signal will remain until a prime signal arrives from the right hand support on line 87R to set latch L20 and provide a 1 signal into or gate 016 whose output 1 signal then forms the second input to and gate A18 to cause it to deliver an output 1 signal to solenoid valve 66. Valve 66 will supply liquid to the advancing jack 61 in the support advancing direction, will supply liquid at pressure to the cantilever jack 59 in the cantilever retracting direction, and liquid to the hydraulic props in the roof beam lowering direction. Thus the support will move forwardly, the forward movement being indicated by the voltage signal picked off from variable resistor R74. As soon as full advance of the conveyor is achieved the difference between the R74 signal fed to comparator C12 and the signal fed to C12 from the junction of resistors R18 and R19 is in the right sense, comparator C12 will deliver a 1 signal to one input of and gate 19 and to reset latch L18. The pressure switch 72 will adopt the connection indicated as a result of low pressure in the roof supporting zones of jacks 57 and thus and gate A19 receives a 1 signal at each of its two inputs, giving an output 1 signal to the solenoid valve 64, causing the latter to supply liquid at pressure to the props 57 to raise the roof beams into supporting engagement with the roof. When the roof beam fully engages the roof the pressure in prop 67 will rise to an extent to switch over the pressure switch 72 which then removes connection from and gate A19 and supplies a 1 signal to the inputs of two and gates A20 and A21. The and gate A20 will still receiving an output 1 signal from latch L20 and will thus deliver an output 1 signal to ine 87L which forms a prime signal for the adjacent logic unit and of course indicates completion of the lower advance set sequence of the support.

Where the coal cutting machine is starting a cutting run along the coal face, it is necessary to be able to cause the first support in the line of supports to undergo its functions of cantilever advance, conveyor push and lower advances set and provision must be made to supply a priming signal for each function. For this purpose, after the cutting machine has passed the first support in the line, the miner will simultaneously press button PB3 and move switch SW to the prime position and then release both. This will cause the prime signal to be generated within the logic unit of the first support for cantilever advance. The miner will then move to another support and press button PB3 to send an enable signal which, at first support, will then cause the cantilever to advance. The miner will then move back to the first support and will simultaneously press button PB4 and move switch SW to the prime position. A prime signal for conveyor push and lower advance set is then generated within the logic unit and the miner will move to another support and press button PB4 in order to send the enable signal.

When the miner simultaneously presses button PB3 and moves the switch SW to the prime position a 1 signal is supplied to and gate A22 from the contacts 2 of PB3, and another 1 signal is supplied into and gate A22 from the contacts SW11 of switch SW. Thus and gate A22 gives out a 1 signal into or gate 012 which will then feed a 1 signal into latch L12 to cause an input 1 signal to be fed to and gate A12. When the miner moves to another support to supply the enable signal monostable M12 will be operated to cause cantilever advance as previously described.

When the miner moves back to the first support and simultaneously presses push button PB4 and operates switch SW the contacts 2 of switch PB4 supply a 1 signal into and gate A23 and the contacts SW14 of switch SW supply another 1 signal into and gate A23. Thus a 1 signal is delivered from A23 into or gate 014 which sets latch L15 to deliver a 1 signal and gate A15. When the miner moves to another support to press button PB4 and gate A15 is operative to cause conveyor push and subsequent lower advance set as previously described.

After the first support has completed contilever advance it will supply a prime signal on line 82L so that the next support on the left is capable of cantilever advance. Similarly when the first support has initiated conveyor push the prime signal is sent on line 85L to the left adjacent support and when the first support has completed its lower advance set sequence a further prime signal will be sent on line 87L to the adjacent left support.

The advantages for the miner that he can position himself within 20 supports from the position where action is taking place and place himself upstream or downstream of the cutting machine apply equally to this embodiment as to the first embodiment.

In both of the described embodiments the descriptions have referred to support operations when the cutting machine is moving from right to left. It will be appreciated, however, that the circuit diagrams are such that similar operation will also take place for movement of the cutting machine from left to right. For this purpose it will be noted that the and gates which send out prime signals are always provided in pairs and the latches which receive prime signals are also provided in pairs. Thus in FIG. 4 it will be noted that and gate A1 will send a prime signal on completion of lower advance set to the left whilst and gate A2 will send a prime signal of completion of lower advance set to the right. Similarly in FIG. 4 it will be noted that L1 will receive a prime signal from the left adjacent support whilst L2 will receive a prime signal from the right adjacent support. In the two described embodiments there have been a number of simplifications to enable understanding of which the following should be noted. The solenoid valves described in both embodiments are all arranged so that when operated to supply liquid at pressure to one end of a jack, or prop, valve means are also operated to connect the opposite end of the ram or prop to drain. Time delays necessary for correct resetting have been omitted. For accurate control at a distance, i.e. near the limit of the predetermined range of supports, the enable signal should pass through a comparator in addition to the illustrated resistors. Comparators based on C.M.O.S. logic may be employed for this purpose.

A number of latches in the circuit diagram of FIGS. 4 and 8 do not show provision for resetting. Such provision, however, is made whereby when at the first support in the line to be operated the movement of switch SW to its self-prime position also causes a reset signal to be supplied to the illustrated latches which apparently have no reset connection.

The switch SW, as previously described, is a three-position switch, and the third position not so far discussed is the lock-out position. The lock-out position is the miners emergency control by which he can halt any support movement whenever a fault develops. The miner's safety operation therefor irrespectively of the support under which he is located is to move the switch SW to the lock out position. The miner can then take action to correct the fault.

Many modifications of the described embodiments may be made within the scope of the present invention. For example, it is not necessary for manually operable control means to be provided on every support in the line of supports. This it will be seen in particular that many supports along the line of supports need not have switch units, provided that at least the number of supports between any two successive supports with the switch units is less than the number of the supports within the range over which an enable signal can extend. Thus, for example, if the enable signal is arranged to extend over twenty supports it will be reasonable to arrange that switch units are provided on every tenth support in the line.

In starting a line of supports in their operations after the cutting machine, the described embodiments show how provision is made that the first support in the line may be self-primed. It is clearly within the possibility of the invention, however, to provide other means for supplying a priming signal to the first support in the line to enable it to carry out the various described functions.

Sometimes it may be necessary to restart coal cutting and the co-operating support functions intermediate the ends of the long wall after there has been a stoppage to correct a fault. The operation of the self-priming switches are then necessary on the support where the various functions are to start. In both embodiments any self-prime signal is arranged to reset the associated direction latches so that on completion of the function prime signals will be sent in both directions. The miner in these circumstances must operate the lock-out switch of the adjacent support which has completed its function so that the prime signal will operate only on the other adjacent support.

I claim:

1. Mining apparatus for use on a mineral face comprising a plurality of roof supports arranged in a line along the face, advancing means for each support, an advance prime signal generating means on each support adapted to generate an advance prime signal on completion of a support advance movement, an advance prime signal transmission means between each adjacent pair of supports adapted to feed an advance prime signal only to a support adjacent to the advance prime signal generator giving the prime signal, a plurality of manually operable controls one on each of some or all of the supports, each of which on actuation is adapted to generate an advance enable signal, advance enable signal transmission means extending between all supports connected to receive and to transmit any advance enable signal, and limiting means associated with the enable signal transmission means adapted to ensure that any advance enable signal may not be carried by said enable signal transmission means for more than a predetermined number of supports from the position of generation of an advance enable signal, each said advancing means being adapted to cause advance of the associated support only on receipt of an advance prime signal and an advance enable signal, said predetermined number of supports being less than the number of supports along the face, and the number of supports between any two successive supports having manually operable controls being not more than said predetermined number.

2. Mining apparatus as claimed in claim 1, including pushing means on at least some of the supports and abutment means such as a conveyor adapted to be urged by the pushing means towards the face and including a push prime signal generator for each pushing means adapted to generate a push prime signal when it is pushing the conveyor, a push prime signal transmission means extending between each adjacent pair of supports adapted to feed any push prime signal only to a support adjacent to the push prime signal generator giving the push prime signal, a second manually operable control on each of some or all of the supports adapted on actuation to generate a push enable signal, a push enable signal transmission means extending between all supports adapted to receive and transmit any push enable signal and push limiting means associated with the push enable transmission means adapted to ensure that said push enable signal may not be carried by said push enable transmission means for more than said predetermined number of supports, each said pushing means being adapted to cause urging forward of the abutment means only on receipt of a push prime signal and an advance enable signal, the number of supports between any two successive supports having second manually operable controls being not more than said predetermined number.

3. Mining apparatus as claimed in claim 1, wherein each support includes a roof support cantilever, cantilever advancing means adapted to advance the cantilever relative to the support, cantilever prime signal generating means on each support adapted to generate a cantilever prime signal on initiation of cantilever advance, cantilever prime signal transmission means between each adjacent pair of supports adapted to feed a cantilever prime signal only to a support adjacent to the cantilever prime signal generator giving the signal, a manually operable cantilever control on each of some or all of the supports adapted on actuation to generate a cantilever enable signal, cantilever enable signal transmission means extending between all supports adapted to receive and to transmit any cantilever advance enable signal and cantileer enable signal limiting means associated with the cantilever enable signal transmission means adapted to ensure that any cantilever advance enable signal may not be carried by said cantilever enable signal transmission means for more than a predetermined number of supports from the position of generation of a cantilever advance enable signal, each said cantilever advancing means being adapted to advance its cantilever only on receipt of a cantilever prime signal and a cantilever enable signal, said predetermined number of supports being less than the number of supports along the face, and the number of supports between any two successive supports having manually operable cantilever controls being not more than said predetermined number.

4. A mining apparatus as claimed in claim 1, wherein the advance enable signal transmission means includes a conductor connected to all supports and the limiting means comprises a resistor inserted into the conductor at each support.

5. A mining apparatus as claimed in claim 2, wherein the push enable signal transmission means includes a conductor common to all supports and the push limiting means comprises a resistor inserted into the conductor at each support.

6. A mining apparatus as claimed in claim 3, wherein the cantilever enable signal transmission means includes a conductor connected to all supports and the cantilever limiting means comprises a resistor inserted into the conductor at each support.

7. A mining apparatus as claimed in claim 1, wherein each support includes a plurality of hydraulic double-acting roof support jacks, e.g. 7 or 57, hydraulically connected in parallel and wherein the support advancing means comprises a hydraulic advancing jack, a first electrically actuated valve, e.g. 15, or 66, which when actuated supplies liquid to lower the roof support jacks and to actuate the advancing jack, an and gate, e.g. A3 or A18 whose output actuates the first valve and whose two inputs comprise the advance prime signal and the advance enable signal, a second electrically actuated valve which when actuated supplies liquid at pressure to the roof supporting jacks to cause the roof support to engage the roof, and a position signalling means, e.g. R24 or R74 responding to a predetermined advance of the support to actuate the second electrically actuated valve.

8. Mining apparatus as claimed in claim 7, including a pressure switch responsive to roof supporting pressure in the roof supporting jacks, a second and gate (e.g. A6 or A19), whose output actuates the second valve and whose two inputs comprise a signal from the position signalling means when the support attains a predetermined advance and a signal from the pressure switch in response to roof engaging pressure in the roof supporting jacks.

9. Mining apparatus as claimed in claim 8, including a third and gate (e.g. A1, A2 or A20, A21), whose output forms an advance prime signal fed to one adjacent support and whose inputs comprise the advance prime signal received from the other adjacent support and the said resetting signal from the pressure operated switch (e.g. 22 or 72).

10. Mining apparatus as claimed in claim 3, including an operative connection between the support advancing means and the cantilever advancing means of a support arranged to cause cantilever withdrawal during support advance.

11. Mining apparatus as claimed in claim 1, wherein the number of supports within the predetermined range is greater than 1 and less than 20.

* * * * *